US006069555A

United States Patent [19]

Skitek et al.

[11] Patent Number: 6,069,555

[45] Date of Patent: May 30, 2000

[54] FACILITY ACCESS SYSTEM AND METHOD WITH DISABLED AND USER ASSISTANCE

[76] Inventors: David G. Skitek, 11716 W. 72$^{nd}$St., Raytown, Mo. 64133; Nighat I. Abidi, 7709 NW. 69$^{th}$St., Kansas City, Mo. 64152; Tharumenthiran Nadarajah, 5000 Oak St., Apt. 1123N, Kansas City, Mo. 64112; Mark E. Brown, 279 Terr. Trail W., Lake Quivira, Kans. 66106

[21] Appl. No.: 09/073,476

[22] Filed: May 6, 1998

[51] Int. Cl.$^{7}$ ..... G08B 5/00

[52] U.S. Cl. ..... 340/286.14; 340/524; 364/130

[58] Field of Search ..... 340/286.14, 525, 340/506, 524, 990, 995, 988; 364/130, 144, 146

[56] References Cited

U.S. PATENT DOCUMENTS

| | | | |
|---|---|---|---|
| 4,086,632 | 4/1978 | Lions | 340/286.14 |
| 4,275,385 | 6/1981 | White . | |
| 4,428,046 | 1/1984 | Chari et al. | 340/825.19 |
| 4,558,300 | 12/1985 | Goldman | 340/286.14 |
| 4,601,064 | 7/1986 | Shipley . | |
| 5,189,394 | 2/1993 | Walter et al. | 340/286.14 |
| 5,334,970 | 8/1994 | Bailey | 340/506 |
| 5,365,449 | 11/1994 | Kashiwazaki | 364/449 |
| 5,616,901 | 4/1997 | Crandall . | |
| 5,621,384 | 4/1997 | Crimmins et al. . | |
| 5,623,358 | 4/1997 | Madey . | |
| 5,689,669 | 11/1997 | Lynch et al. | 395/355 |
| 5,838,262 | 11/1998 | Kershner et al. | 340/945 |

*Primary Examiner*—Nina Tong
*Attorney, Agent, or Firm*—Litman, Kraai & Brown L.L.C.

[57] ABSTRACT

A facility access system includes a system microprocessor and input and output subsystems. The input subsystem can include switching devices connected in a parallel configuration for actuating the system microprocessor in a sequencing mode of operation. Input devices are also disclosed which produce input signals corresponding to particular memory storage locations for accessing directional and other information in a look-up mode of operation. The directional and other information is output to text display, graphical display and audio output devices. A user's computer can be linked to the system microprocessor for downloading information therefrom. An emergency subsystem provides emergency exit information, dials out to summon assistance and includes a backup power source.

11 Claims, 13 Drawing Sheets

FACILITY ACCESS SYSTEM AND METHOD WITH DISABLED AND USER ASSISTANCE

BACKGROUND OF THE INVENTION

1. Field of the Invention

The present invention relates generally to facility accessibility, and in particular to an interactive system and method for providing directions and emergency assistance to facility users, including users with disabilities.

2. Description of the Prior Art

The built environment includes both public and private sector facilities which are utilized for residential, occupational, commercial, educational, healthcare, entertainment, institutional, governmental and other purposes. Buildings of various types have a wide range of different configurations., which can make it difficult for users to locate particular destinations therein. Users of such facilities tend to rely on existing systems and devices, such as building directories, for directional assistance.

Building directories are commonly placed at convenient locations for reference by visitors seeking particular destinations within the buildings. The lobbies of many commercial and institutional buildings include such building directories, which typically list the occupants or tenants and their room or office numbers. However, building directories generally provide only limited information, such as a room or office number matched with a corresponding occupant's or tenant's name. Many existing building directories lack specific, detailed directions to destinations within the buildings in which they are located. Such directories are of limited use to users who are unfamiliar with the buildings in which they are located. Consequently, first-time visitors often get lost or disorientated or waste time seeking destinations in unfamiliar facilities.

Another common type of directional assistance device found in many facilities includes a graphic display, such as a floor plan, with various locations, destinations and travel paths depicted thereon. Such graphical displays are typically located at accessible locations in lobbies, foyers, corridors, etc. However, many prior art graphical displays were essentially static, i.e. lacking interaction with users. Moreover, many graphical displays include two-dimensional printed floor plans of the facilities in which they are installed, and thus require an ability on the user's part to read and interpret a floor plan in order to find a particular destination. Such displays thus provide only limited contributions to improving accessibility. They are often unusable by disabled users, particularly those with vision disabilities.

Large commercial facilities commonly have reception and information accommodations occupied by receptionists and security personnel. Although personal interaction with a receptionist or a security guard may have advantages from the user's point of view, salaries and other expenses associated with receptionists and security personnel can add significantly to operating costs. The costs associated with such personnel are often prohibitive, particularly in the case of smaller facilities which may be unable to afford personnel with reception and security responsibilities.

In many cases it is more efficient to obtain information directly from an automated system as opposed to engaging a receptionist or a security officer in dialog. Moreover, an automated system is often better suited for storing and retrieving large amounts of data corresponding to directional information associated with a large number of destinations in a large facility.

Modern facilities often include life safety systems for assisting with evacuation and for summoning assistance in the event of a fire or some other emergency. Various types of emergency lighting, audible alarms and communication devices are typically installed. Such life safety equipment is often mandated by the applicable building codes. However, interaction with disabled users is limited for many existing life safety systems.

Heretofore there has not been a facility access system and method with disabled user assistance with the advantages and features of the present invention.

SUMMARY OF THE INVENTION

In the practice of the present invention, a facility access system is provided which includes a system microprocessor and input and output subsystems connected thereto. The input subsystem includes a plurality of input devices for accommodating users with different disabilities. The output subsystem also includes different output devices for accommodating users with different disabilities. A data storage device is connected to the microprocessor for storing data representing directions to predetermined destinations in a facility in which the system is installed. A power system includes a backup power source which can be charged by a photovoltaic solar collector. In the practice of the method of the present invention, a signal from one of a plurality of input devices is detected by a microprocessor, which produces an output comprising data associated with a facility. The system is adapted to operate either according to a sequential method of operation or a look-up table method of operation. A user's computer can be linked to the system microprocessor and receive data downloaded therefrom. The downloaded data can be displayed on the user's computer and can correspond to directions to a destination within the facility.

OBJECTS AND ADVANTAGES OF THE INVENTION

The principal objects and advantages of the present invention include: providing a facility access system and method, providing such a system and method which are interactive with a user; providing such a system and method which are adaptable to various facilities; providing such a system and method which can be employed by persons with various disabilities; providing such a system and method which provide alternative user interface methods; providing such a system and method which can interface with a user's microprocessor; providing such a system and method which can be used to help control access to predetermined areas in a facility; providing such a system and method which can facilitate the emergency evacuation of a facility; and providing such a system and method which are economical to manufacture, efficient in operation, capable of a long operating life and particularly well adapted for the proposed usage thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE PREFERRED EMBODIMENTS

Figure 1:
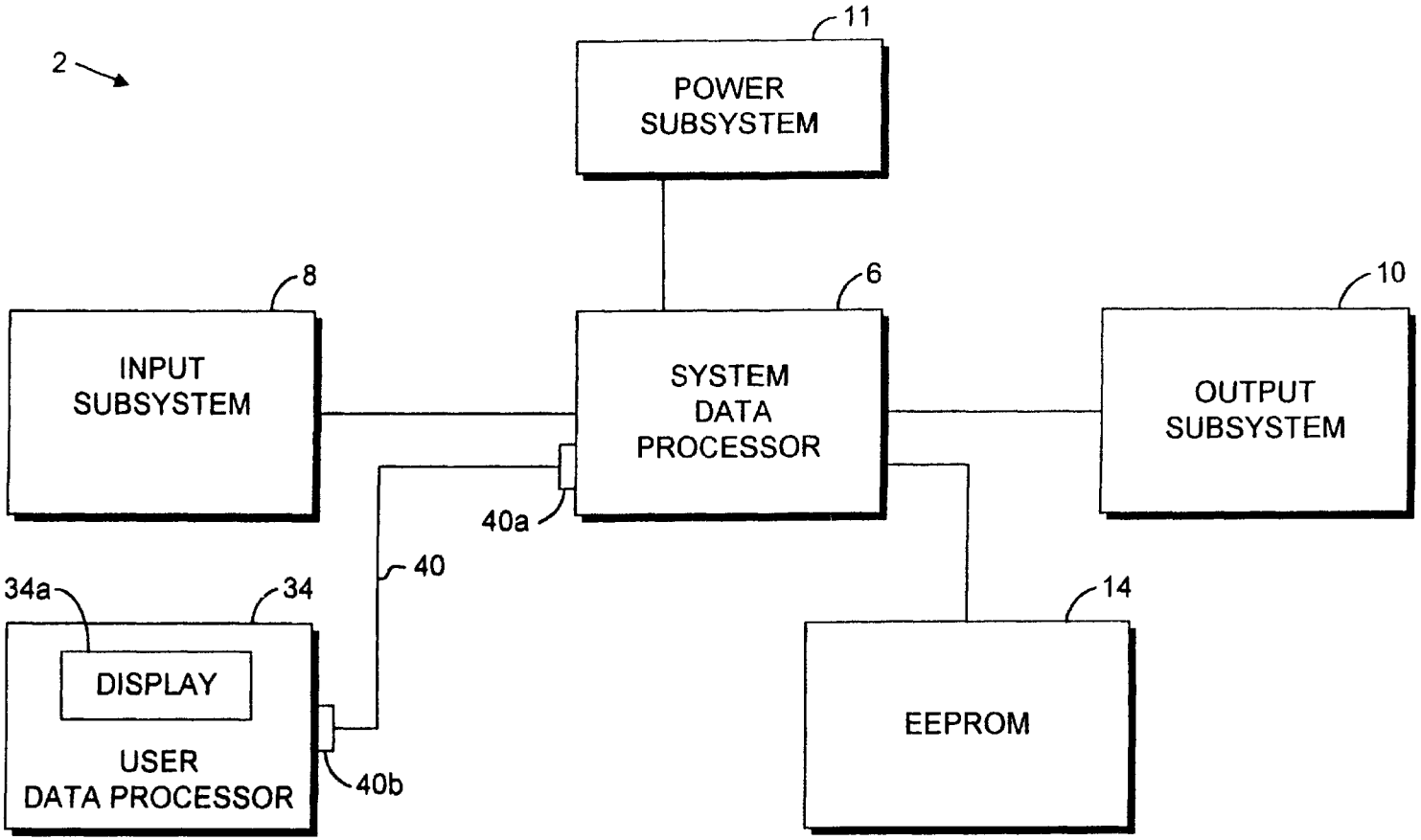
FIG. 1 is a block diagram of a facility access system with disabled user assistance embodying the present invention.

I. Introduction and Environment.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail, the reference numeral 2 generally designates a facility access system with disabled user assistance embodying the present invention. Without limitation on the generality of useful applications of the facility access system 2, it is shown in conjunction with a facility 4 (FIG. 2) which includes a plurality of rooms, several of which are identified as example destinations and designated 4*a,b,c*. The facility 4 also includes multiple emergency exits 4*d*.1–5 and corridors 4*e*. One of the corridors 4*e* serves as an entry foyer 4*f* adjacent to a main entry 4*g*.

The directional assistance system 2 (FIG. 1) generally includes a system data processor 6, an input subsystem 8, an output subsystem 10, a power subsystem 11 and a user data processor 34.

II. System Data Processor 6.

The data processor 6 could be selected from a wide variety of commercially available units. For example, the processor 6 could be specified based upon the requirements of a particular application, such as types of input/output (I/O) devices, resident memory, clock speed, instruction set suitability, etc. Without limitation on the generality of useful microprocessors, a BASIC Stamp® II microprocessor from Parallax, Inc. of Rocklin, Calif. 95765 is disclosed and described herein. The *BASIC Stamp® Manual*, version 1.8 from Parallax, Inc. is incorporated herein by reference. The software disclosed herein in connection with the facility access system 2 and method is written in a programming language identified as PBASIC™ for the Parallax BASIC Stamp® II microprocessor, but could be rewritten in various other programming languages for other microprocessors within the scope of the present invention.

Figure 3:
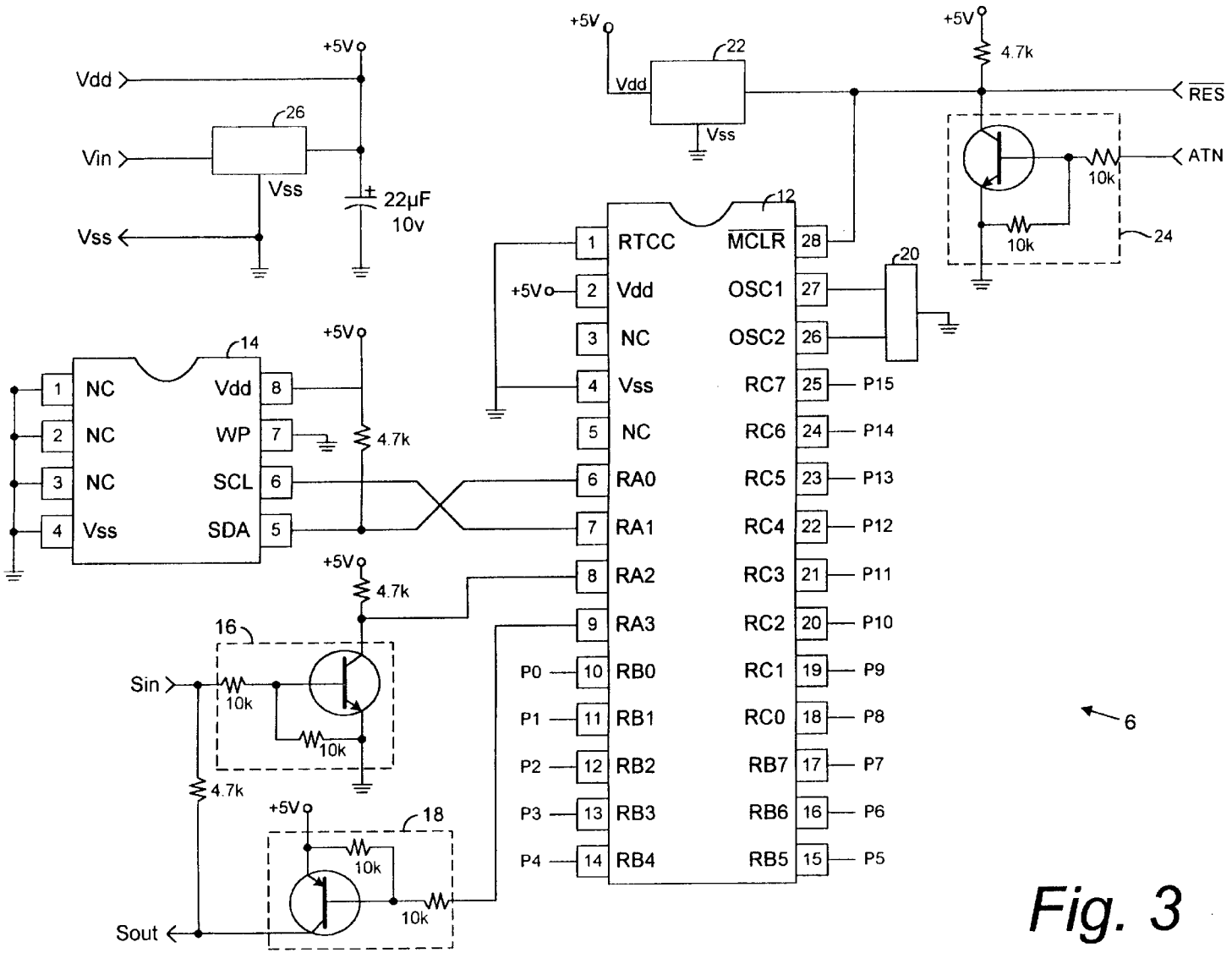
FIG. 3 is a schematic diagram of a system data processor of the access system.

A schematic diagram of the BASIC Stamp® II microprocessor 6 is shown in FIG. 3. The microprocessor 6 has an interpreter integrated circuit (IC) 12 with 28 pins, which are labeled 1–28 in FIG. 3. Pin 1 (RTCC) and pin 4 (Vss) are grounded to Vss. Pin 2 (Vdd) is connected to a positive five volt power supply 13, which in turn is connected to the power subsystem 11. Pins 3 and 5 are not used in this application. Pin 6 (RAO) and Pin 7 (RA1) are connected to an EEPROM 14, which can contain, for example, 2 kB of memory. Pin 8 is connected to a serial input (Sin) circuit 16 and pin 9 (RA3) is connected to a serial output (Sout) circuit 18. Pins 10–25 (RB0–RB7 and RC0–RC7) respectively comprise the I/O pins P0–P15 of the microprocessor 6, and can be programmed to function as either inputs or outputs.

Pins 26 and 27 (0SC2 and OSC1 respectively) are connected to a 20 MHz ceramic resonator 20. Pin 28 (MCLR not) is connected to a reset 22. Pin 28 (MCLR not) is also connected to a reset/attention circuit 24.

19 III. Input Subsystem 8.

Figure 4:
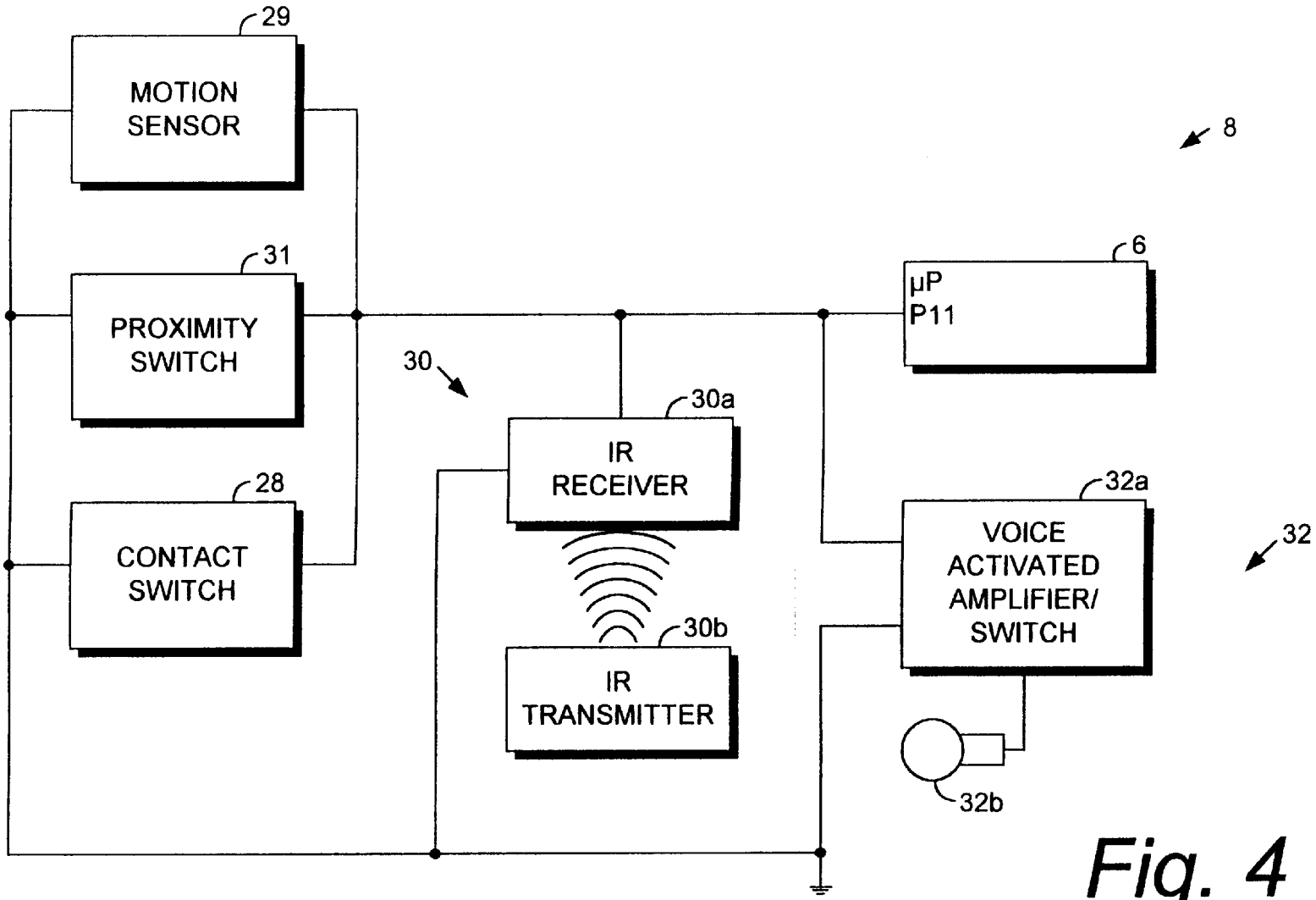
FIG. 4 is a schematic diagram of an input subsystem of the facility access system.

The input subsystem 8 includes a plurality of switching (grounding) input devices as described below and connected in parallel between input pin P11 and ground, as shown in FIG. 4. A contact (e.g., push-button) switch 28 is preferably located for convenient access by a user of the facility 4. A wireless (IR) switch 30 includes an IR receiver circuit 30*a* connected to ground and to P11 for grounding same upon receipt of a transmitted IR signal from an IR transmitter circuit 30*b*. A voice activated switch 32 includes an amplifier and switching circuit 32*a* connected to P11 and to ground. A microphone 32*b* is connected to the amplifier/switching circuit 32*a*. A motion sensor switch 29 and a proximity switch 31 are also connected to ground and to P11 for grounding input P11 in response to detecting motion or a user respectively.

The grounding switches 28–32 are connected in parallel between ground and input P11 whereby closing any of them grounds P11, i.e. places a "0" thereon for activating the processor 6.

IV. User Data Processor 34.

Figure 5:
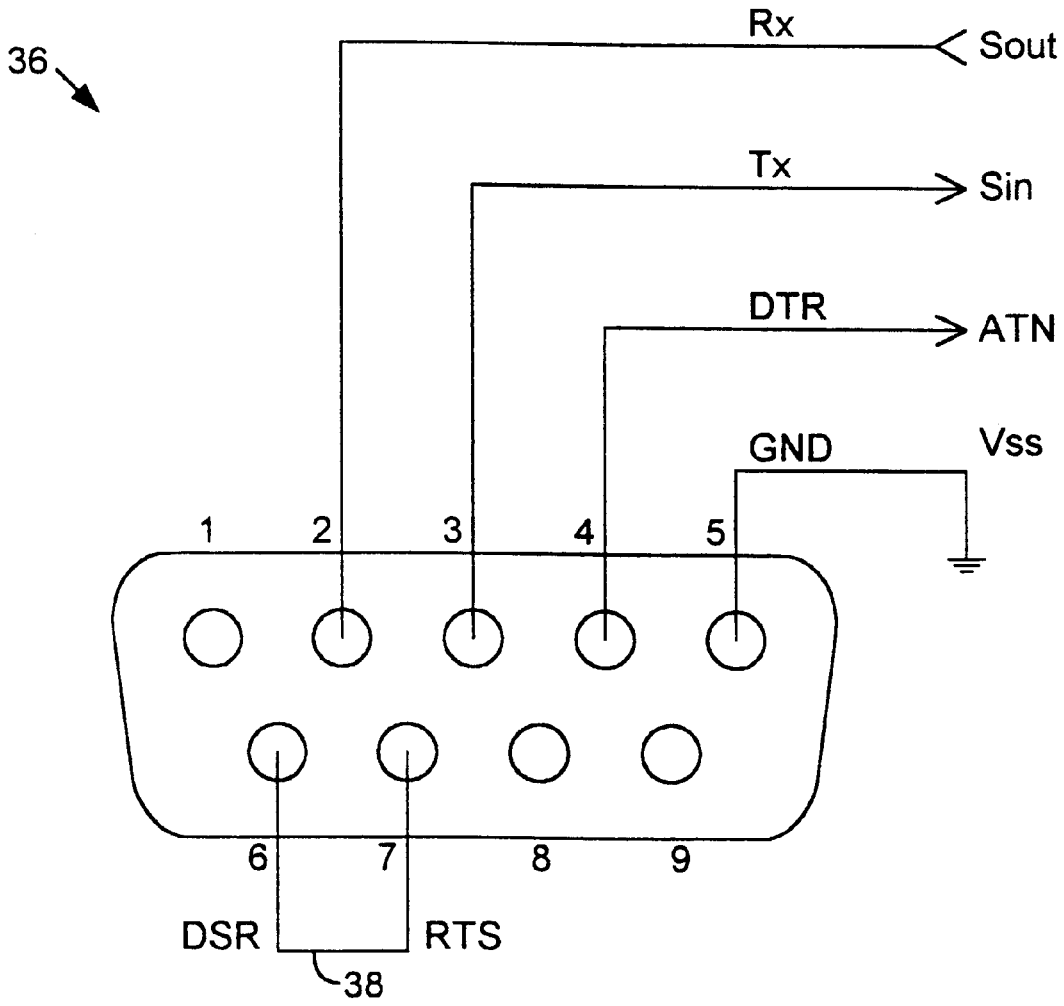
FIG. 5 is a schematic diagram of a serial interface between the system data processor and a user data processor.
Figure 6:
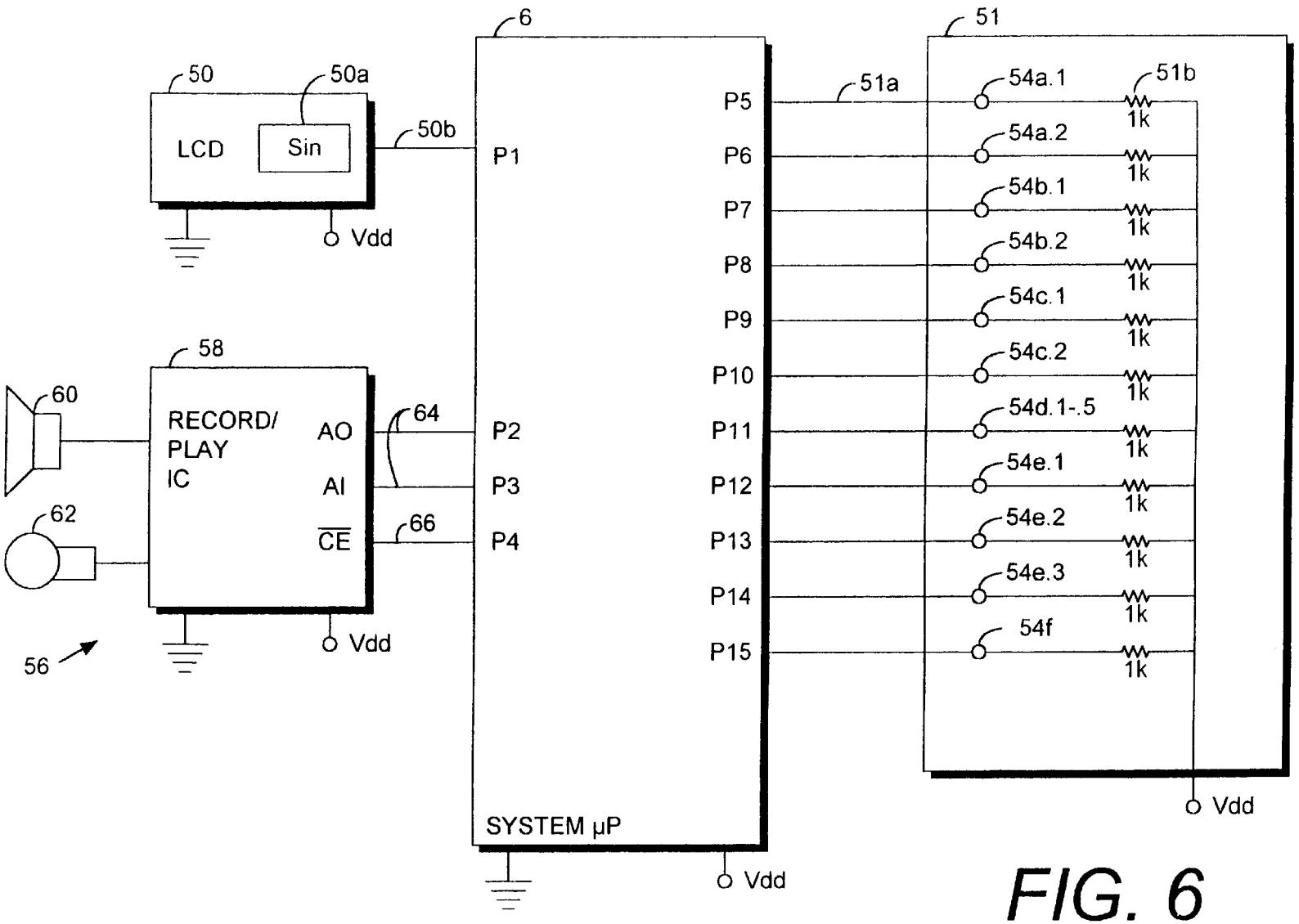
FIG. 6 is a schematic diagram of an output subsystem of the facility access system.
Figure 7:
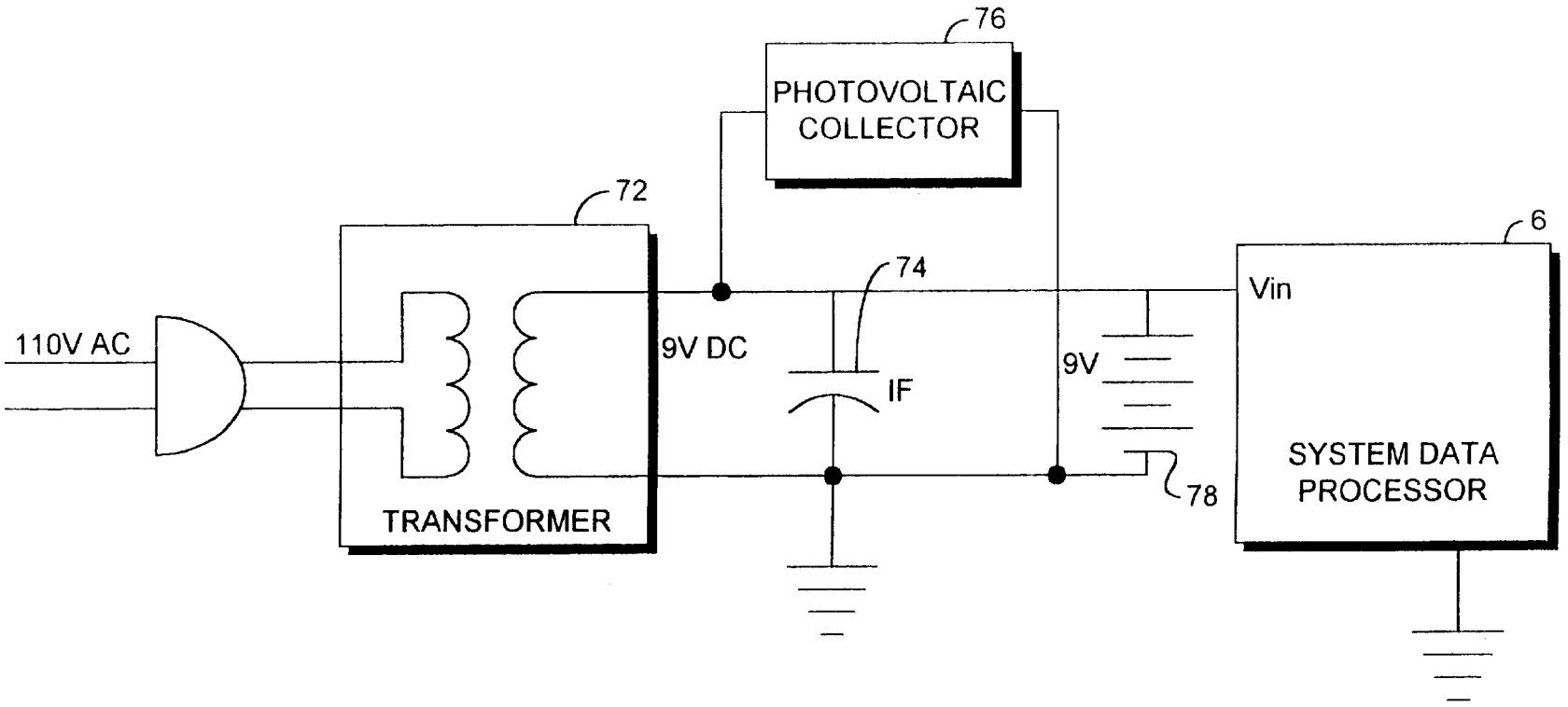
FIG. 7 is a schematic diagram of a power subsystem of the facility access system.

In addition to the parallel grounding switches 28–32 described above, a user data processor (e.g., microprocessors 34 can be utilized as an I/O device for operating the system microprocessor 6. The user microprocessor 34 can be connected to the system microprocessor 6 with an RS-232 specification serial interface 36, as shown in FIG. 5 with pins designated 2, 3, 4 and 5 connected to system microprocessor 6 inputs Sout, Sin, ATN and Vss respectively. Pins 6 and 7 are connected by a jumper 38 and permit the microprocessor software to identify the port of the user microprocessor 34 to which the system microprocessor 6 is connected. The system and user microprocessors 6, 34 can be connected by a serial cable 40 with DB9 programming connectors 42*a,b* at the respective ends thereof. Sout is a serial data output line from the system processor 6 to the user microprocessor 34. Sin is a serial data input line whereby the system processor 6 receives serial data transmission from the user microprocessor 34. ATN is a control line for controlling the direction of data transfer between the system processor 6 and the user microprocessor 34. The user microprocessor 34 includes a display 34*a*, which can comprise, for example, a display screen with the user microprocessor 34 comprising a portable, battery-powered personal computer, e.g. a "notebook" or "laptop" computer.

V. Output Subsystem 10.

The output subsystem 10 includes a text output device comprising an LCD 50 with a serial interface 50*a* connected to an output pin P1 of the system microprocessor 6, Vdd and ground. The serial interface 50*a* includes storage capacity comprising ASCII text characters and various other symbols. Serial inputs to the serial interface 50*a* via control line 50*b* from the processor 6 result in text and/or character messages being displayed on the LCD 50.

Figure 2:
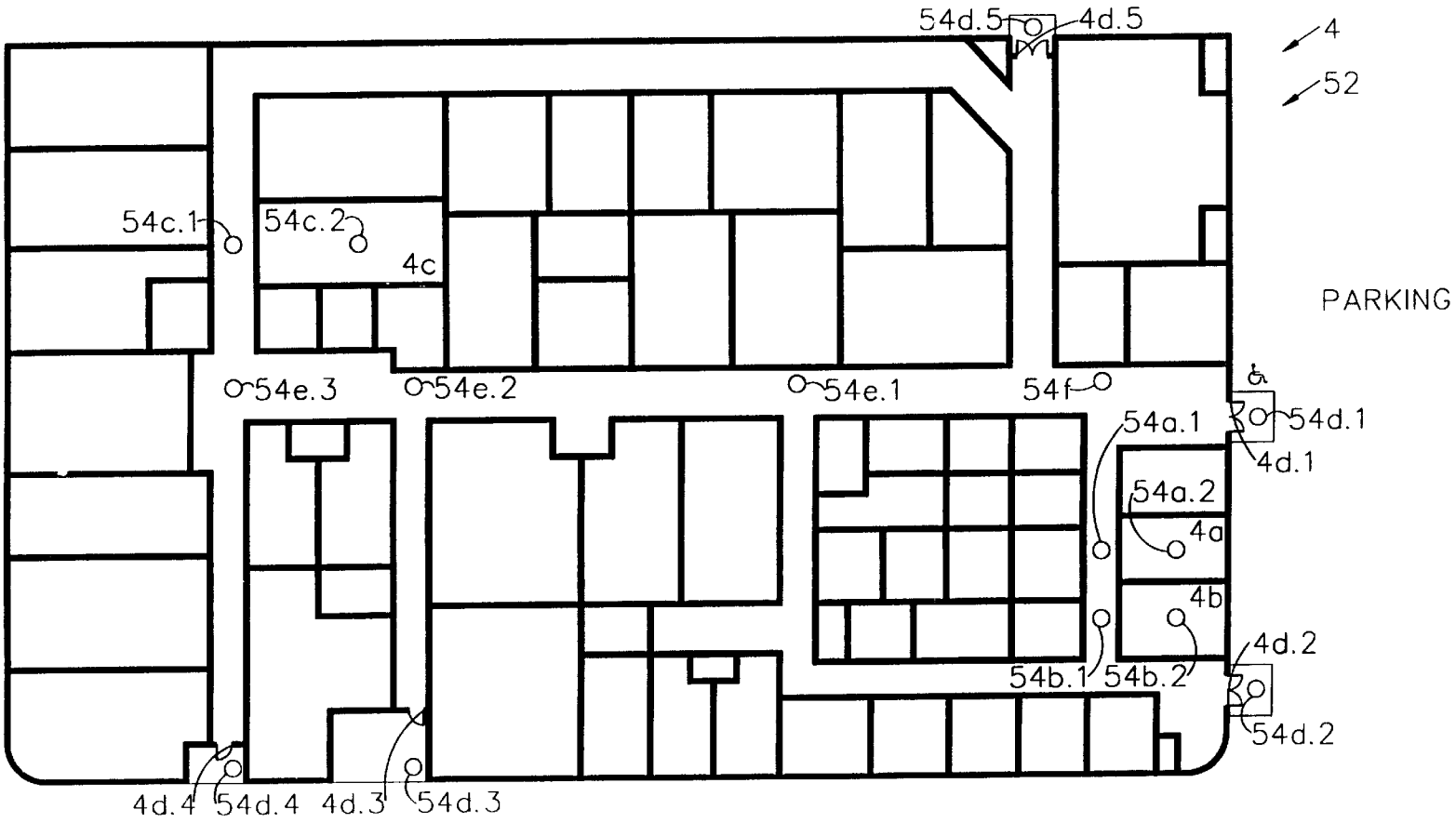
FIG. 2 is a graphical display of a facility equipped with the access system, particularly showing predetermined destinations and travel paths thereto.

A graphical display device 51 including a plan diagram representation 52 of the facility 4 is connected to the system processor 6 and includes a plurality of visual signal devices, such as LED's 54, corresponding to locations along different travel paths in the facility 4 (FIG. 2). For example, a point-of-origin LED 54*f* can be located in the facility foyer 4*f*. The LED's include three LED pairs 54*a*.1,*a*.2; 54*b*.1,*b*.2; 54*c*.1,54*c*.2 associated with respective room destinations 4*a,b,c*. Exit location LED'S are designated 54*d*.1–5 and are located at the building exits 4*d*. 1–5 respectively. Main or central corridor LED's 54 *e*.1–3 are located in the corridor 4*e*. Foyer LED 54*f* is located in the building foyer 4*f*, which can correspond to the location of the facility access system 2. The LED's 54 are connected to respective output pins P5–P15 of the system microprocessor 6 by control lines 51*a*. The LED's 54 are also connected to Vdd through resistors 51*b*(1 kΩ).

A third output device comprises an audio (voice) record/play circuit 56. The audio circuit 56 includes a record/play integrated circuit (IC) 58. Without limitation on the generality of useful record/play devices, a suitable device is available from Information Storage Devices, Inc. of San Jose Calif. 95125 under its trademark DAST™ (direct analog storage technology). The model ISD1000A device is sufficient for a relatively small-scale application of the facility access system 2. The audio circuit 56 includes a speaker 60 connected to the record/play IC 58. A microphone 62 can optionally be connected to the record/play IC 58 for recording audio messages, e.g., voice messages corresponding to the messages being displayed on the LCD 50. The record/play IC includes address inputs A0, A1 which are connected to output pins P2, P3 of the system microprocessor 6 by addressing lines 64. The addressing inputs A0, A1 provide for accessing four memory locations in the record/play IC 58, which are enabled by a signal from the output pin P4 to an enable input CE via an enable line 66.

VI. Power Subsystem 11.

The power system 11 includes a power source connected to Vin of the system data processor 6. The power source can comprise a transformer 72 connected to a source of 110 V 60 Hz AC power and transforming same to a DC voltage in the range of about 5 V to 15 V for connection to the system data processor 6 and to ground. A 1F capacitor 74 functions as a backup electrical storage device and is connected in parallel with the outputs of the transformer 72. A photovoltaic solar collector 76 is connected to the capacitor 74 for charging same and is preferably mounted in a suitable location to receive direct solar insolation. In the event of a power failure which could eliminate the transformer 72 as a power source, the capacitor 112 will continue to provide operating current to the device 2. A rechargeable backup battery 78 could be provided in place of or in addition to (e.g., connected to and parallel with) the capacitor 74.

VII. Sequential Method of Operation.

Figure 8:
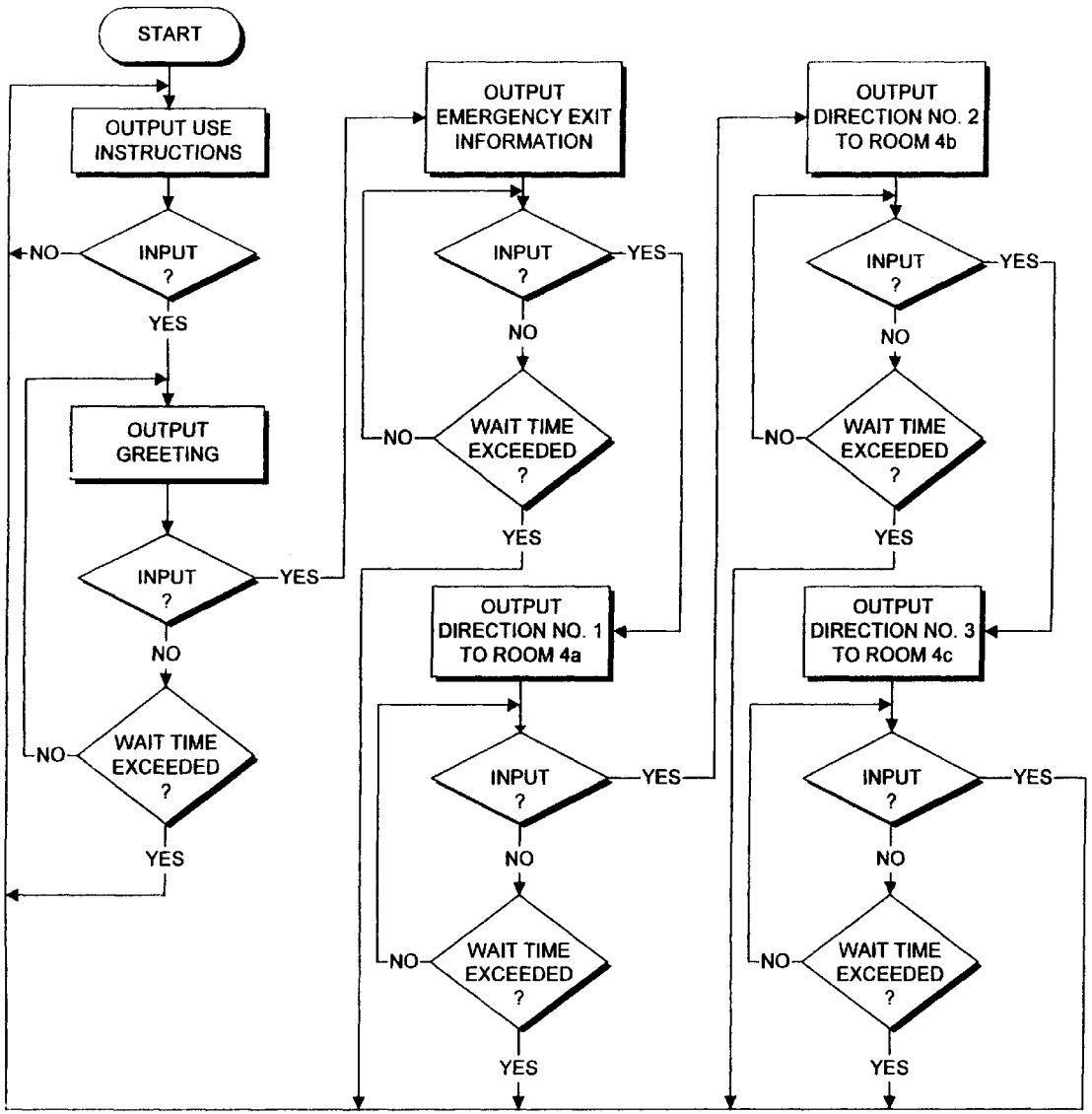
FIG. 8 is a flow chart depicting a facility access method embodying the present invention.

FIG. 8 is a flow chart showing a sequential method of operation according to the present invention, which corresponds to the steps or subroutines of a program loaded on the microprocessor 6 for controlling the operation of the facility access system 2. At the beginning of the program a greeting and/or instructional message is displayed, telling a user how to activate the system, such as: "Press button, transmit [infrared], speak or link to a serial port."

Figure 8A:
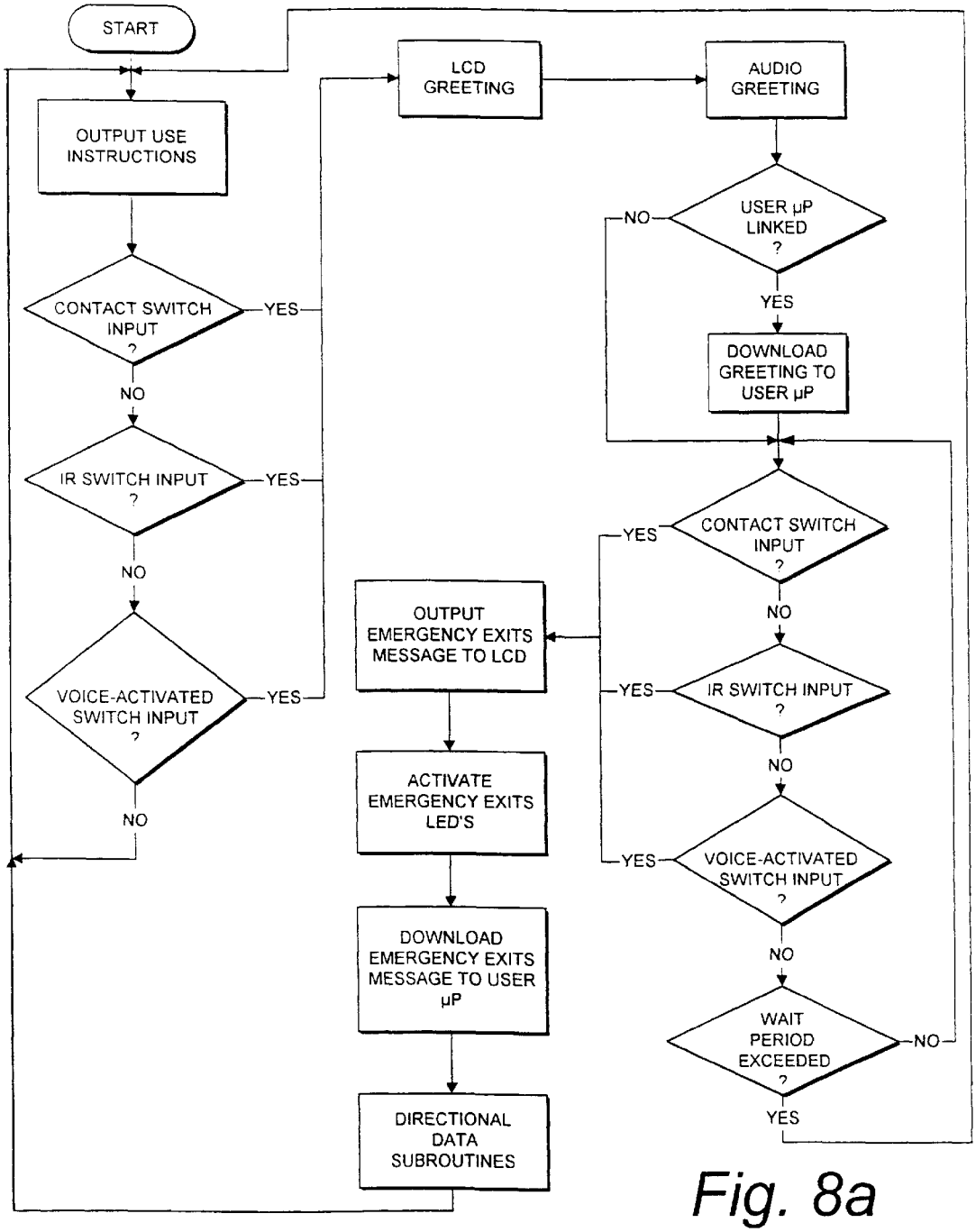
FIG. 8*a* is a flow chart depicting a portio of the sequential access method.
Figure 8B:
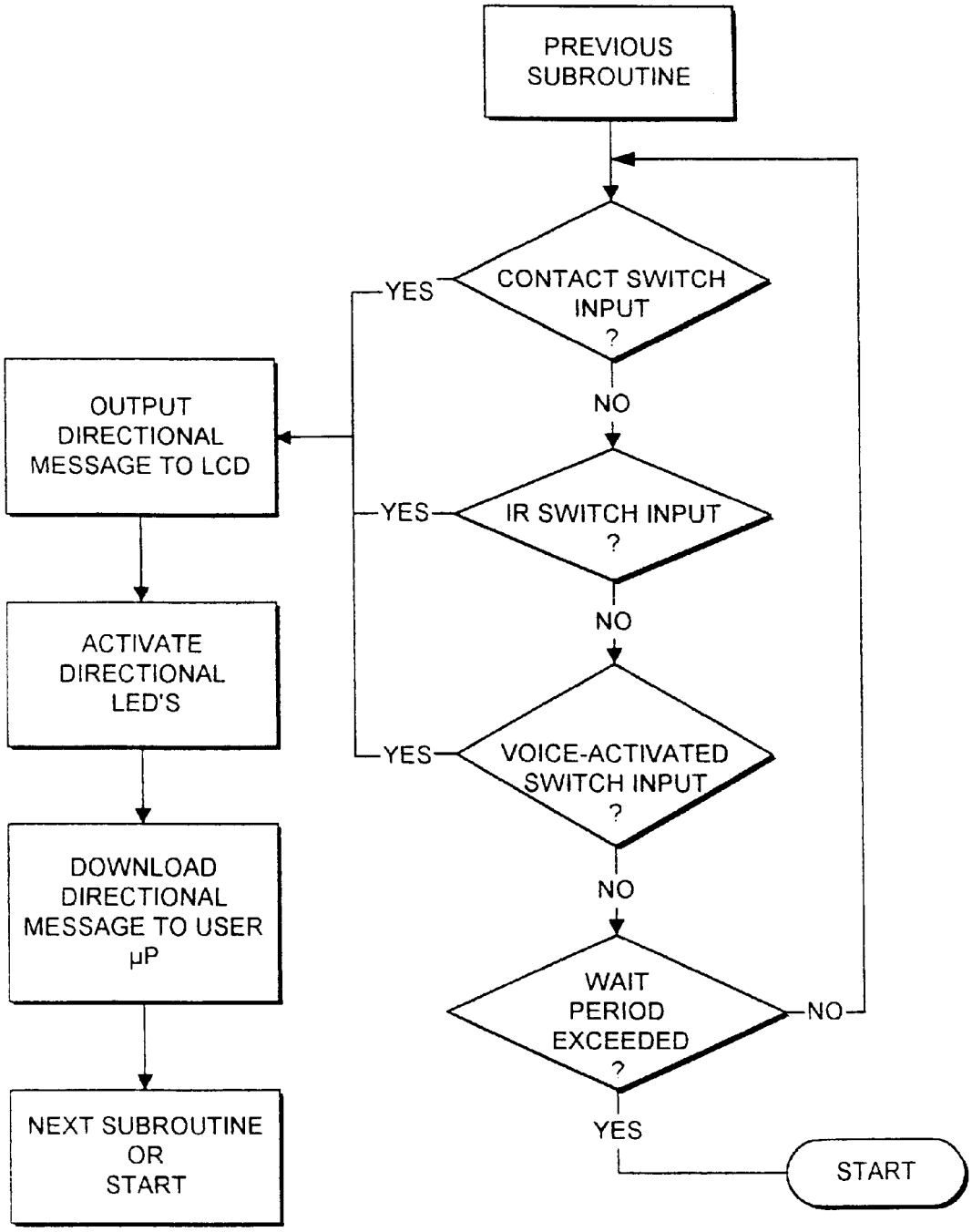
FIG. 8*b* is a flow chart depicting a portion of the sequential access method.

Upon receipt of an appropriate signal, the system processor 6 sequences to the next subroutine, which can comprise an identification of the facility's emergency exits 4*d*.1–5 whereby the exit LED's 54*d*.1–5 are flashed and an appropriate textual message is displayed and/or an audio output is played, such as: "Emergency Exits" (FIG. 8*a*). The next actuation of the input subsystem 8 results in a directional message (FIG. 8*b*), such as the following: "Room 4*a* can be reached by turning left and going about 30 feet. Room 4*a* is on your left." Appropriate directional messages can be provided for other destinations, and outputting same can be sequenced.

After a predetermined wait time period in any one subroutine is exceeded, the program can automatically return to the beginning.

VIII. First Modified Embodiment Facility Access System 102.

Figure 9:
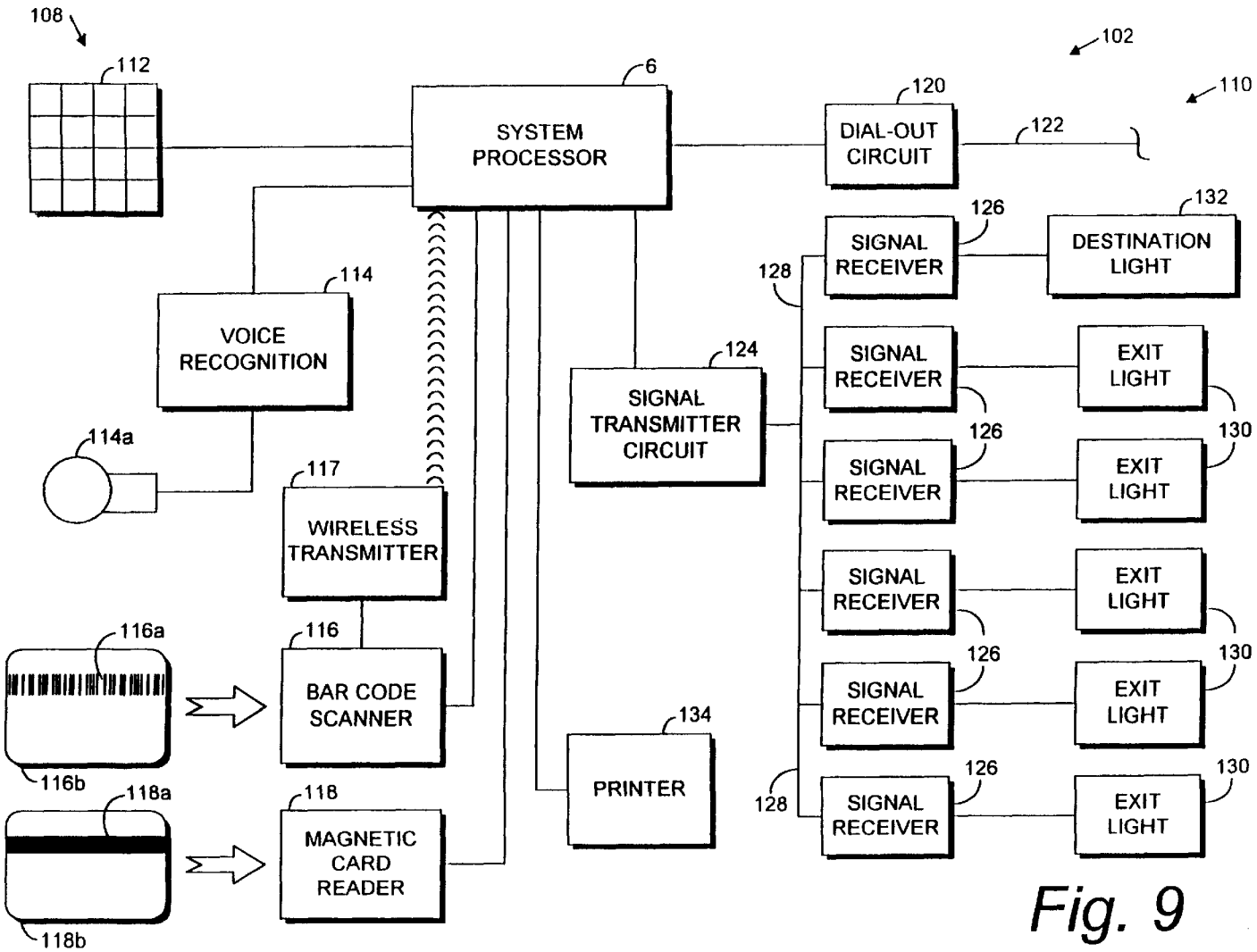
FIG. 9 is a block diagram of a facility access system with disabled user assistance comprising a first modified embodiment of the present invention.

A facility access system 102 comprising a first modified embodiment of the present invention is shown in FIG. 9 and generally includes modified input and output subsystems 108, 110. As shown in FIG. 9, the input subsystem 108 includes input devices such as a sixteen key alphanumeric keypad 112, a voice recognition circuit 114 including a microphone 114*a*, a bar code reader 116 adapted to read a bar code 116*a* printed on an access card 116*b*, and a magnetic strip reader 118 adapted to read a magnetic strip 118*a* on a card 118*b*. Other types of devices for producing coded input signals could also be employed within the scope of the present invention, such as a wireless transmitter 117 connected to the bar code reader 116 and adapted to transmit data therefrom to the system processor 6. Each of the input devices, 112, 114, 116, 117, 118 produces a signal and communicates same to the microprocessor 6. The microprocessor 6 locates the address of a predetermined data group in its data storage, such as the EEPROM 14, and outputs the appropriate directional or other message to the output subsystem 110 and/or the user's data processor 34.

The output subsystem 110 can include the LCD circuit 50, the graphical display device 51 and the audio circuit 56 described above in connection with the primary embodiment of the present invention. Further, the modified output subsystem 110 can include a dial-out circuit 120 comprising an interface of the type which is generally designated a "Data Access Arrangement" (DAA) with FCC approval. A source of an appropriate DAA is Cernetek Microelectronics, 406 Pasman Drive, Sunnyvale, Calif. 94089. The dial-out circuit 120 can be connected to a dedicated telephone service line 122 of the facility 4 whereby a predetermined number is dialed upon receiving an appropriate actuating symbol from the system processor 6. An appropriate message, for example, a message summoning assistance, can be output on the telephone service line 122. The dial-out circuit 120 can thus function as a appropriate emergency safety feature of the first modified system 102. In the event of an emergency, a facility user could actuate the dial-out circuit 120 and summon assistance. In non-emergency applications, the dial-out circuit 120 could be used to communicate with an occupant of one of the destination rooms 4*a,b,c*. For example, a signal could be transmitted indicating that a visitor were present.

A signal transmitter circuit 124 and a signal receiver circuit 126 collectively provide an output device utilizing the electrical wiring 128 in the facility 4. The components of the circuits 124, 126 are available from X-10 USA Inc. of Seattle, Wash. 98188, which produces a variety of products for transmitting and receiving signals over the existing electrical wiring of a facility. The signals are adapted to control various electrical devices from remote locations within a structure. An emergency application of the circuits 124, 126 involves the actuation of exit lights 130 from a remote location, such as the system processor 6. The transmitting circuit 124 places an appropriate signal on the facility wiring 128, which is detected by the receiving circuit 126 and activates the exit lights 130. A non-emergency application could involve, for example, energizing a destination signal light 132 in proximity to a destination such as one of the rooms 4*a,b,c*.

A printer 134 comprises yet another output device and is connected to the system microprocessor 6. The printer 134 is adapted to produce printouts with directions to destinations, route maps, facility information, etc. for use by facility users.

IX. Look-Up Method of Operation.

Figure 10:
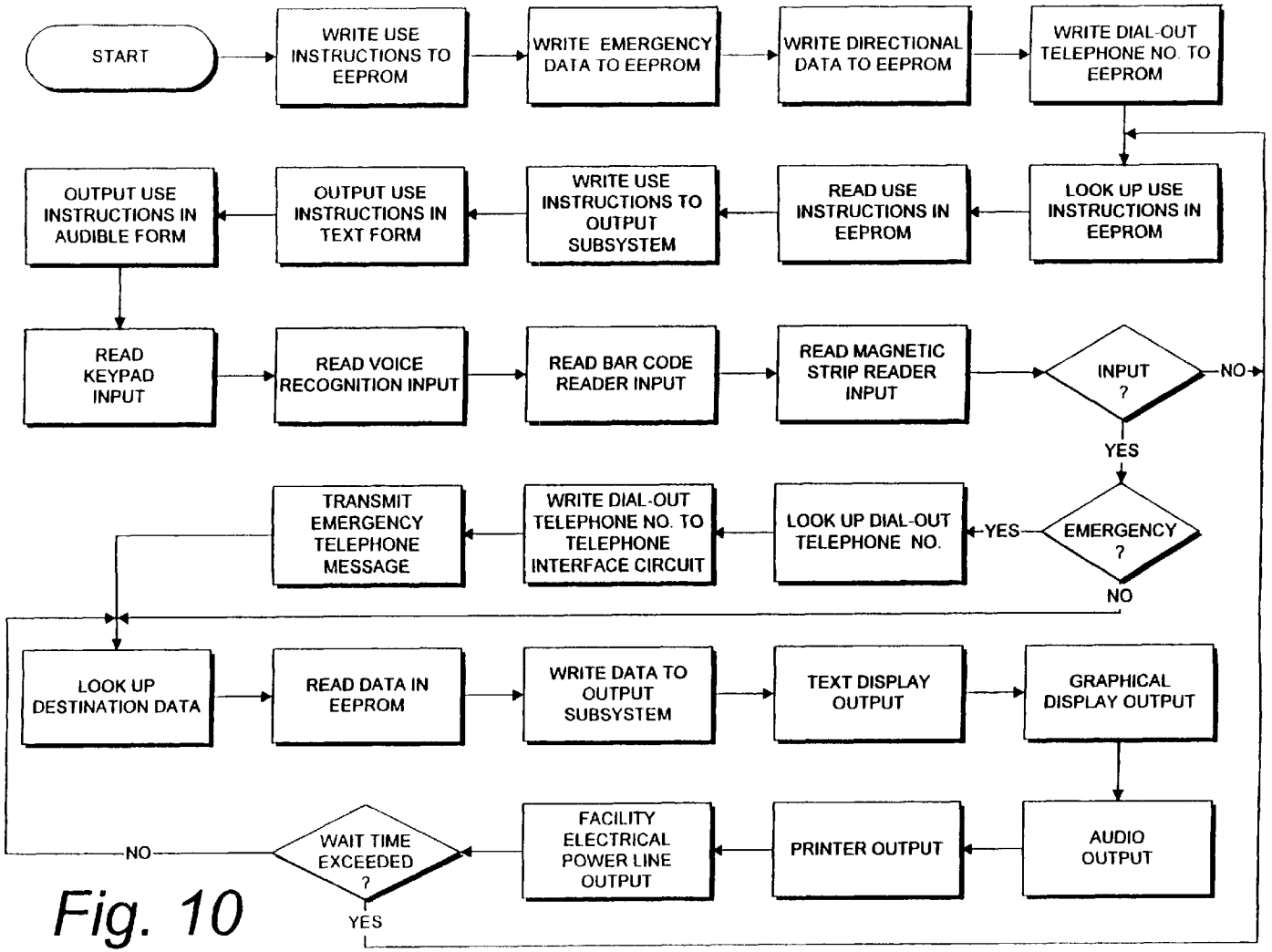
FIG. 10 is a flow chart of a facility access method using the first modified embodiment facility access system.
Figure 11:
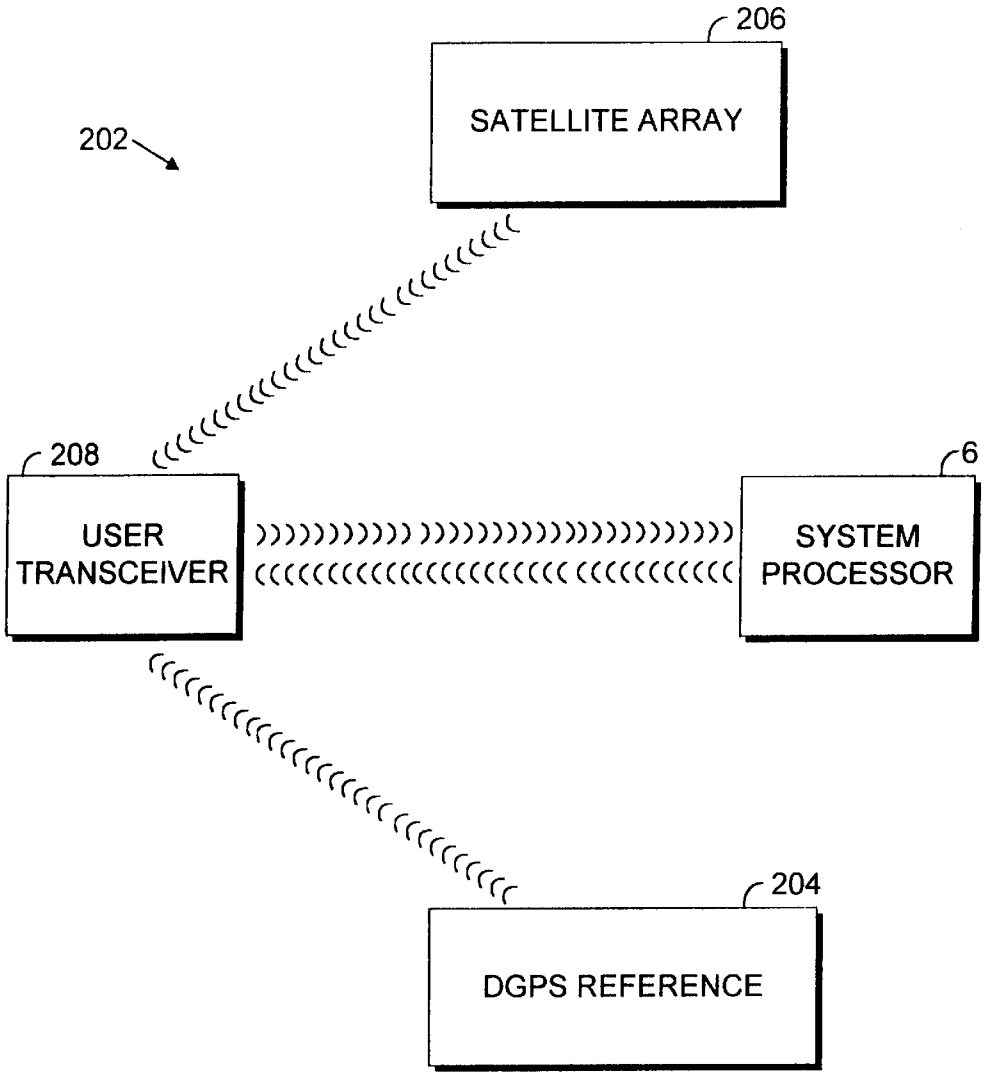
FIG. 11 is a block diagram of a facility access system with disabled user assistance comprising a second modified embodiment of the present invention.

FIG. 10 is a flow chart showing the steps in a look-up method of operation embodying the present invention. Upon receiving a signal from the input subsystem 108, the system processor 6 locates the corresponding data in the EEPROM 14, for example, utilizing a suitable addressing technique, and causes the corresponding directional message or other message to be output to the output subsystem 110. After a predetermined delay, the program can then return to its beginning.

X. Second Modified Embodiment Facility Access System 202.

A facility access system 202 comprising a second modified embodiment of the present invention is shown in FIG. 12 and utilizes a global positioning system (GPS) transceiver 208 for tracking the location of a visitor to the facility 4 and communicating directional data thereto. A preferred form of global positioning system technology involves a differential global positioning system (DGPS) which utilizes a fixed reference receiver 204, for example at the facility 4. The fixed reference receiver 204 receives signals from one or more satellites in a satellite array 206, whose positions are known and tracked with respect to the fixed reference 204. The user transceiver 208 is carried by a visitor in the facility 4 whereby his or her position within the facility can be determined and communicated to the system processor 6. The DGPS coordinates of one or more of the destinations 4*a,b,c* with respect to the fixed reference transceiver 204 and the satellite array 206 can be tracked, and the user's position compared to the destination position. The system processor 6 can then generate and transmit directions to the user transceiver 208 for communicating travel path directions and other information to the user.

Differential GPS Explained and GPS—A Guide to the Next Utility, by Trimbel Navigational Limited, Sunnyvale, Calif. 94088-3642 (1993) are incorporated herein by reference.

It is to be understood that while certain forms of the present invention have been illustrated and described herein, it is not to be limited to the specific forms or arrangement of parts described and shown.

What is claimed and desired to be secured by Letters Patent is as follows:

1. A facility access system, which comprises:

a) a system data processor with an input and an output;

b) an input subsystem connected to said system processor input;

c) an output subsystem connected to said system processor output;

d) data storage accessible by said output subsystem for providing output data associated with the facility to the output subsystem;

e) said input subsystem including a hardwired switching device and a wireless switching device; whereby a user with a disability could operate at least one of said switching devices; and f) a plurality of software subroutines selected by the user and accessible by said system processor and each outputting data corresponding to a respective destination associated with the facility to said output subsystem; said data including directions to said destination; and g) an external device associated with the facility and activated by the output subsystem in response to a user input to the input subsystem.

2. The facility access system according to claim 1 wherein said system processor includes said data storage and said system processor is adapted to write directional data associated with the facility to said data storage.

3. The facility access system according to claim 1 wherein said data storage is connected to said system processor and said system processor is adapted to write directional data associated with the facility to the data storage.

4. The facility access system according to claim 1 wherein said switching device comprises a contact switch.

5. The facility access system according to claim 1 wherein said switching device comprises an infrared-actuated switching circuit including an infrared receiver connected to said system data processor and a remote infrared transmitter.

6. The facility access system according to claim 1 wherein said switching device includes a voice-actuated switching circuit connected to said system data processor.

7. The facility access system according to claim 1 wherein said output subsystem includes an LCD display for displaying textual messages comprising said directions to destinations within the facility.

8. The facility access system according to claim 1 wherein said output subsystem includes:

a) a graphical representation of the facility; and b) a plurality of indicators mounted on said graphical representation and corresponding to travel paths in the facility to predetermined destinations therein.

9. The facility access system according to claim 8, which includes:

a) said output indicators comprising LED's; and b) said system processor selectively and sequentially activating said LED's along a plurality of predetermined travel paths.

10. The facility access system according to claim 1 wherein said output subsystem includes:

a) an audio circuit including a speaker for playing prerecorded, stored messages comprising directions to predetermined destinations in the facility.

11. The facility access system according to claim 1 wherein said output subsystem includes:

a) said facility having an electrical power system;

b) a signal transmitter connected to said system processor and to said facility electrical power system;

c) a signal receiver connected to said facility electrical power system and adapted to receive signals from said signal transmitter; and d) said signal receiver including a switching circuit adapted to activate an electrical device in response to receiving a signal from said signal transmitter.

* * * * *